US008100697B2

(12) United States Patent
Budryk et al.

(10) Patent No.: US 8,100,697 B2
(45) Date of Patent: Jan. 24, 2012

(54) PORTABLE RETRACTABLE ERASABLE WRITING SURFACE

(75) Inventors: Robert Budryk, Tewksbury, MA (US); Tobin J. Fisher, San Francisco, CA (US)

(73) Assignee: ZipBoard, Inc., Tewksbury, MA (US)

( * ) Notice: Subject to any disclaimer, the term of this patent is extended or adjusted under 35 U.S.C. 154(b) by 440 days.

(21) Appl. No.: 12/401,942

(22) Filed: Mar. 11, 2009

(65) Prior Publication Data

US 2009/0233265 A1 Sep. 17, 2009

Related U.S. Application Data

(60) Provisional application No. 61/036,057, filed on Mar. 12, 2008, provisional application No. 61/057,487, filed on May 30, 2008.

(51) Int. Cl.
*B43L 1/00* (2006.01)

(52) U.S. Cl. ..... 434/412; 434/415; 434/416; 434/423; 434/426; 434/430

(58) Field of Classification Search ..... 434/412, 434/415, 416, 423, 426, 430
See application file for complete search history.

(56) References Cited

U.S. PATENT DOCUMENTS

| | | | | |
|---|---|---|---|---|
| 382,705 | A | 5/1888 | Kane | |
| 1,136,575 | A * | 4/1915 | Wohlcke et al. | 434/412 |
| 1,583,998 | A * | 5/1926 | Richey | 40/517 |
| 2,230,668 | A | 2/1941 | Ohrtmann | 33/138 |
| 2,311,413 | A * | 2/1943 | Persson | 160/20 |
| 2,346,908 | A | 4/1944 | Corley | 45/131 |
| 2,498,855 | A * | 2/1950 | Hutt | 40/603 |

(Continued)

FOREIGN PATENT DOCUMENTS

| | | |
|---|---|---|
| DE | 2225551 | 12/1973 |
| DE | 3146962 | 6/1983 |
| GB | 2009827 | 6/1979 |
| WO | WO 94/29126 | 12/1994 |

OTHER PUBLICATIONS

"Screen shots from YouTube of Readius reader device," http://www.youtube.com/watch?v=uQMBzXaCmqff, YouTube.com, 8 pages, Dec. 17, 2007.

(Continued)

*Primary Examiner* — Gene Kim
*Assistant Examiner* — Joseph B Baldori
(74) *Attorney, Agent, or Firm* — Sunstein Kann Murphy & Timbers LLP

(57) ABSTRACT

A portable, retractable writing surface device provides a writing surface that may be extended from a housing and held sufficiently flat by the device to facilitate marking on the writing surface with a writing implement, such as a dry-erase marker, chalk, grease crayon, pencil, pen, permanent marker or the like. The device maintains sufficient rigidity in the extended writing surface, such that the device may be used without an additional support surface, such as a clip board or table. The writing surface may be retracted back into the housing to protect the writing surface and to reduce the size of the device for storage or transport, such as within a pocket or briefcase. Retracting the writing surface may include rolling the writing surface onto a spool, accordion folding the writing surface or otherwise reconfiguring the writing surface to make it fit into a compact space (collectively referred to herein as "compressing" the writing surface). One or more resilient members may be used to make the extended writing surface flat when the writing surface is extended from the housing. The writing surface may include a flexible computer display screen.

23 Claims, 7 Drawing Sheets

U.S. PATENT DOCUMENTS

| | | | | |
|---|---|---|---|---|
| 3,750,995 | A | 8/1973 | Genger | 248/324 |
| 4,157,626 | A * | 6/1979 | Bedinghaus | 40/518 |
| 4,345,392 | A * | 8/1982 | Cornell | 40/116 |
| 4,761,139 | A * | 8/1988 | Mashiach | 434/410 |
| 5,024,898 | A | 6/1991 | Pitts et al. | 428/511 |
| 5,097,611 | A * | 3/1992 | Smollar et al. | 40/514 |
| 5,263,866 | A | 11/1993 | Campbell | 434/416 |
| 5,711,523 | A * | 1/1998 | Sternberg et al. | 273/153 R |
| 5,966,854 | A * | 10/1999 | Walsh et al. | 40/514 |
| 6,549,230 | B2 | 4/2003 | Tosaya | 348/14.08 |
| 6,676,205 | B2 * | 1/2004 | Lin | 296/214 |
| 6,682,352 | B2 | 1/2004 | Lopez | 434/408 |
| 7,428,792 | B2 * | 9/2008 | Kochan et al. | 40/586 |
| 7,901,213 | B1 | 3/2011 | Beno | 434/412 |
| 7,901,214 | B1 * | 3/2011 | Liebowitz et al. | 434/412 |
| 2003/0006603 | A1 | 1/2003 | Pontecorvo | 281/31 |
| 2005/0235215 | A1 * | 10/2005 | Dunn et al. | 715/740 |
| 2005/0243416 | A1 * | 11/2005 | Choi | 359/460 |
| 2006/0279840 | A1 * | 12/2006 | Yamauchi | 359/461 |
| 2007/0006498 | A1 | 1/2007 | Collins | 40/610 |
| 2010/0055661 | A1 * | 3/2010 | Hegwood | 434/420 |

OTHER PUBLICATIONS

"Rollable Paper-like Screens," http://www.futureofthebook.org/blog/archives/2005/08_rollable_paperlike_screens.html, 4 pages, Aug. 2, 2005.

"Philips flexes its display muscles," CNET Asia Photo Gallery, 2 pages, Sep. 27, 2005.

Tom Cheyney "Manufacturing progress key to flexible electronics' success," SmallTimes, 2 pages, May 2007.

"Readius eBook AReader," Readius by Polymer Vision, Jan. 12, 2009, 4 pages.

Shimpi et al. "Philips Rollable Display Demo," CES 2006, 5 pages, Jan. 7, 2006.

Authorized Officer Bernard Louvion PCT/US2009/036768, *International Search Report*, Jun. 29, 2009, 3 pages.

Authorized Officer Irina Becker PCT/US2009/036768, *Notification of Transmittal of the International Search Report*, Jun. 29, 2009, 9 pages.

* cited by examiner

Section B-B

Section B-B

PORTABLE RETRACTABLE ERASABLE WRITING SURFACE

CROSS REFERENCE TO RELATED APPLICATIONS

This application claims the benefit of U.S. Provisional Patent Application No. 61/036,057, filed Mar. 12, 2008, titled "Portable Compressible Writing Device" and U.S. Provisional Patent Application No. 61/057,487, filed May 30, 2008, titled "Portable Retractable Erasable Writing Surface," the entire contents of all of which are hereby incorporated by reference herein, for all purposes.

TECHNICAL FIELD

The present invention relates to erasable writing surfaces and, more particularly, to portable retractable erasable writing surfaces.

BACKGROUND ART

Sports coaches and others frequently use clipboards and other rigid surfaces to convey instructions to players. These boards are commonly referred to as "coach's boards" or "coaching boards." Some such boards hold paper diagrams of playing venues, such as basketball courts, football fields, hockey rinks and the like. Other such boards include chalk boards, dry-erase boards or magnetic boards, with or without permanent markings corresponding to lines, goals, etc. on playing surfaces. Coaches write, or more frequently draw diagrams, on the boards to indicate intended plays, movements by players, expected movements by opposing players, strategies, etc.

SUMMARY OF THE INVENTION

An embodiment of the present invention provides a portable writing device. A housing defines a slit. A writing surface is configured for extension and retraction through the slit. The writing surface is attached at one edge to a handle and is configured to wind within the housing, such as spirally on a spool disposed within the housing and parallel to the slit, when the writing surface is retracted into the housing. A first resilient member is configured for extension and retraction from the housing or from the handle and to wind within the housing or the handle, such as spirally on the spool, when the first resilient member is retracted into the housing or the handle, as the case may be. For example, the first resilient member may be configured to wind on the spool when the writing surface is retracted into the housing.

The first resilient member is also configured such that, when the writing surface is extended, the writing surface is sufficiently rigid to avoid objectionable deflection in the course of handwriting on the writing surface. That is, a user may write or draw by hand on the writing surface with a pencil, erasable marker, stylus or the like (depending on the composition of the writing surface), applying typical writing pressure on the writing surface, without the writing surface deflecting more than a typical cardboard-backed paper note pad would deflect under similar writing pressure, without requiring an additional support surface, such as a clip board or table.

The writing surface may be made of or include paper, a markable erasable surface or a flexible computer display screen. The writing surface or a substrate thereof may include non-erasable indicia corresponding to markings on a game playing surface, such as a basketball court or a football field.

The first resilient member may have a shape memory such that, when the first resilient member is not wound, the first resilient member takes on a curved shape, as viewed in a cross section taken transverse to the direction in which the first resilient member extends from the housing.

The writing device may include an exit ramp disposed within the housing. The exit ramp is shaped to complement the curved shape of the first resilient member. The exit ramp is configured to support a portion of the first resilient member.

The portable writing device may also include a second resilient member configured for extension and retraction from the housing or from the handle and spirally wind when the second resilient member is retracted into the housing or into the handle. For example, the second resilient member may be configured for extension and retraction through the slit, and the second resilient member may be configured to wind on the spool. One end of each of the resilient members may be attached to the handle. The handle, the first and second resilient members and (optionally) the spool may be configured such that, when the writing surface is in an extended position, the handle, the first and second resilient members and (optionally) the spool form at least part of a frame for the writing surface.

The first and second resilient members each may have a shape memory such that, when not wound on the spool, the resilient member takes on a curved shape, as viewed in a cross section taken transverse to the direction in which the resilient member extends from the housing.

The first and second resilient members may include spring steel or a shape memory polymer.

The portable writing device may also include a spring disposed within the housing, coupled to the spool and configured to urge the spool to rotate so as to retract the writing surface. A releasable latch or brake may be coupled to the spool and/or to one or more of the resilient members and configured to selectively prevent the spool from rotating or the resilient member from retracting into the housing.

The portable writing device may also include a compressible resilient sheet attached to one surface of the writing surface and coextensive with at least a writing portion of the writing surface.

The portable writing device may also include a receptacle configured to releasably hold a writing implement.

Another embodiment of the present invention provides a portable writing device that includes a housing and a flexible writing surface. The writing surface may be retractably disposable within the housing. The writing surface has a first position, in which the writing surface is disposed within the housing. The writing surface also has a second position, in which a substantial portion of the writing surface is disposed outside of the housing. The portable writing device also includes a first structural member attached to the writing surface. When the writing surface occupies the first position, at least a portion of the first structural member is disposed within the housing. When the writing surface occupies the second position, a substantial portion of the first structural member is disposed outside of the housing.

The writing surface may be made of or include paper, a markable erasable surface or a flexible computer display screen. The writing surface or a substrate thereof may include non-erasable indicia corresponding to markings on a game playing surface, such as a basketball court or a football field.

The first structural member may include a telescopic member or a spring steel member.

The portable writing device may also include a second structural member attached to the writing surface. When the writing surface occupies the first position, at least a portion of the second structural member is disposed within the housing. When the writing surface occupies the second position, a substantial portion of the second structural member is disposed outside of the housing. When the writing surface occupies the second position, the writing surface extends substantially flat between the first and second structural members.

The second structural member may include a telescopic member.

The portable writing device may also include a compressible resilient sheet attached to one surface of the writing surface and coextensive with at least a writing portion of the writing surface.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, apparatus are disclosed for providing a portable, retractable writing surface device. The writing surface may be extended from a housing and held sufficiently flat by the apparatus to facilitate marking on the writing surface with a writing implement, such as a dry-erase marker, chalk, grease crayon, pencil, pen, permanent marker or the like. The device maintains sufficient rigidity in the extended writing surface, such that the device may be used without an additional support surface, such as a clip board or table. The writing surface may be retracted back into the housing to protect the writing surface and to reduce the size of the device for storage or transport, such as within a pocket or briefcase. Retracting the writing surface may include rolling the writing surface onto a roller, accordion folding the writing surface or otherwise reconfiguring the writing surface to make it fit into a compact space (collectively referred to herein as "compressing" or "retracting" the writing surface). One or more resilient members may be used to make the extended writing surface flat and sufficiently rigid when the writing surface is in an extended position from the housing. The writing surface may include, or it may be replaced by, a flexible computer display screen.

Figure 1:
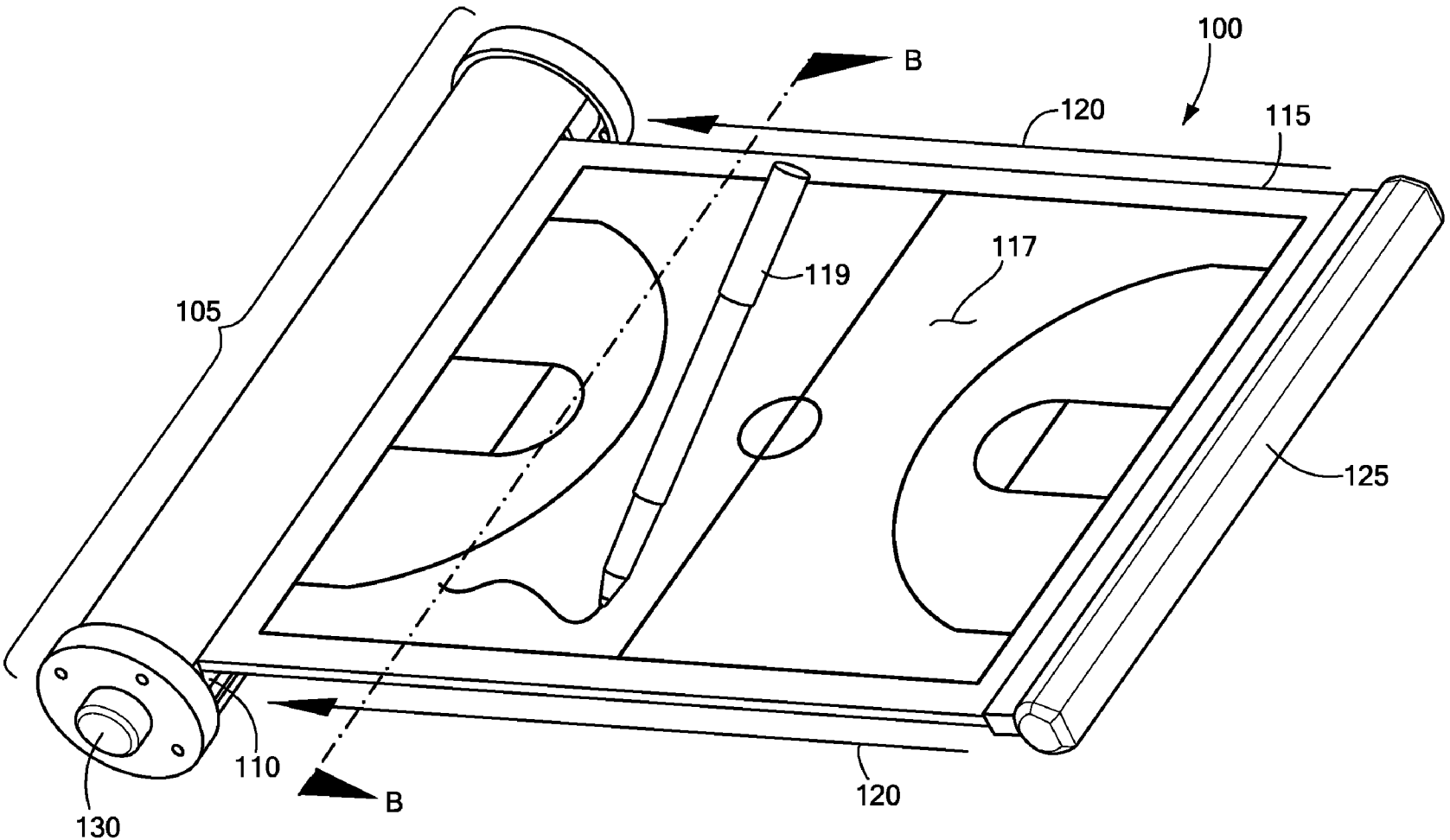
FIG. 1 is a perspective view of a portable retractable erasable writing device, with a retractable writing surface shown in an extended position, according to one embodiment of the present invention.

FIG. 1 is a perspective view of one embodiment of a portable retractable erasable writing device 100. A housing 105 defines a slit 110, through which a retractable member 115 may be extended and retracted. The retractable member 115 may include a writing surface 117 on one or both sides thereof. A writing implement, such as a dry-erase marker 119, may be used to write or draw on the writing surface 117 of the retractable member 115. The writing surface 117 may include indicia corresponding to outlines of and/or markings on a playing surface, such as a basketball court. Different, identical or no indicia may be included on the bottom 300 (FIG. 3) of the retractable member 115. One or both sides of the retractable member 115 may include advertising.

Figure 2:
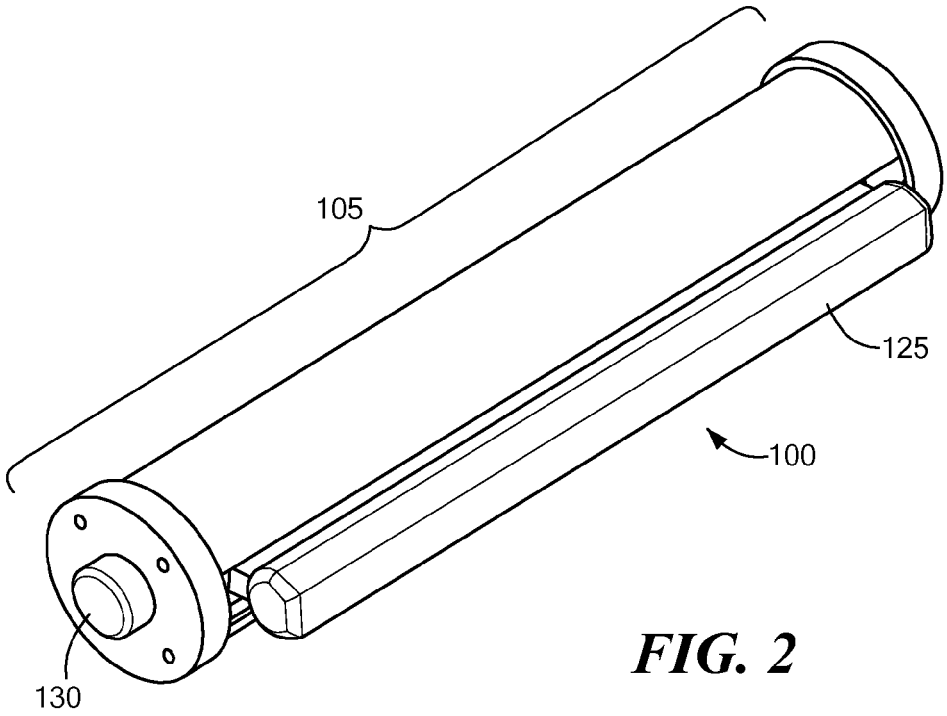
FIG. 2 is a perspective view of the writing device of FIG. 1, with the retractable writing surface shown in a retracted position.
Figure 3:
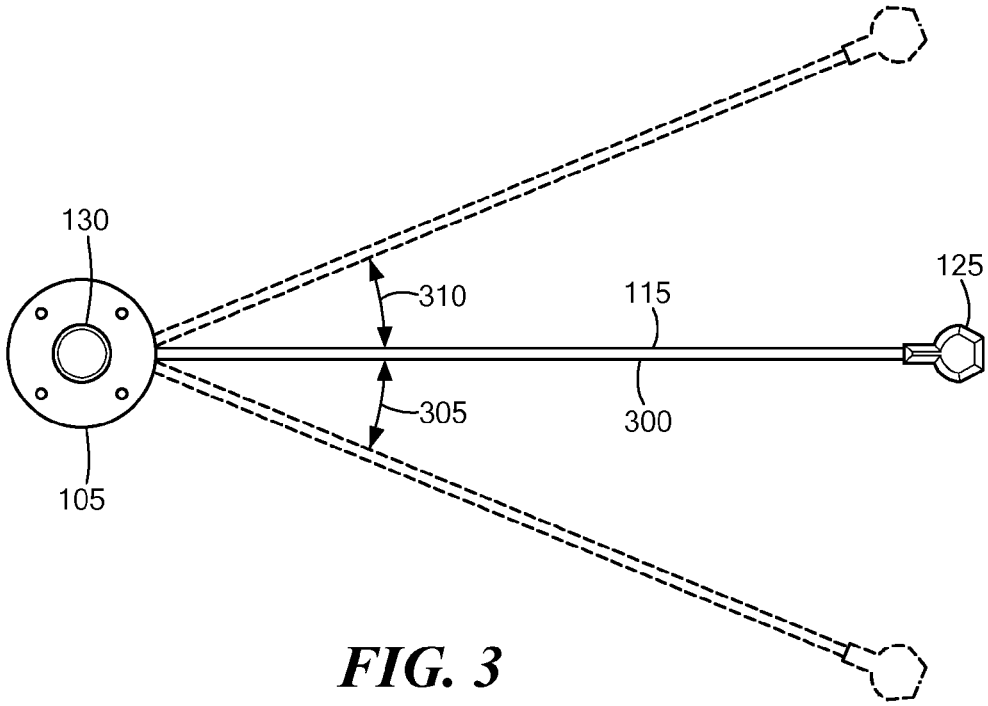
FIG. 3 is a side view of the writing device of FIG. 1 with the retractable writing surface shown in the extended position.

FIG. 1 shows the retractable member 115 fully extended. The retractable member 115 may be retracted back into the housing 105, as indicated by arrows 120. FIG. 2 shows the writing device 100 with the retractable member 115 fully retracted into the housing 105. A rigid handle 125 is attached to one edge of the retractable member 115. The retractable member 115 may be extended by pulling on the handle 125, relative to the housing 105. The handle 125 may be wider and/or longer than the slit 110 to prevent the retractable member 115 from fully retracting into the housing 105. FIG. 3 is a side view of the writing device 100 with the retractable member 115 fully extended. The housing 105 may include mechanical components that cooperate to compress the retractable member 115, as described below. The components may be activated by a button 130 or other releasable latch.

Figure 4:
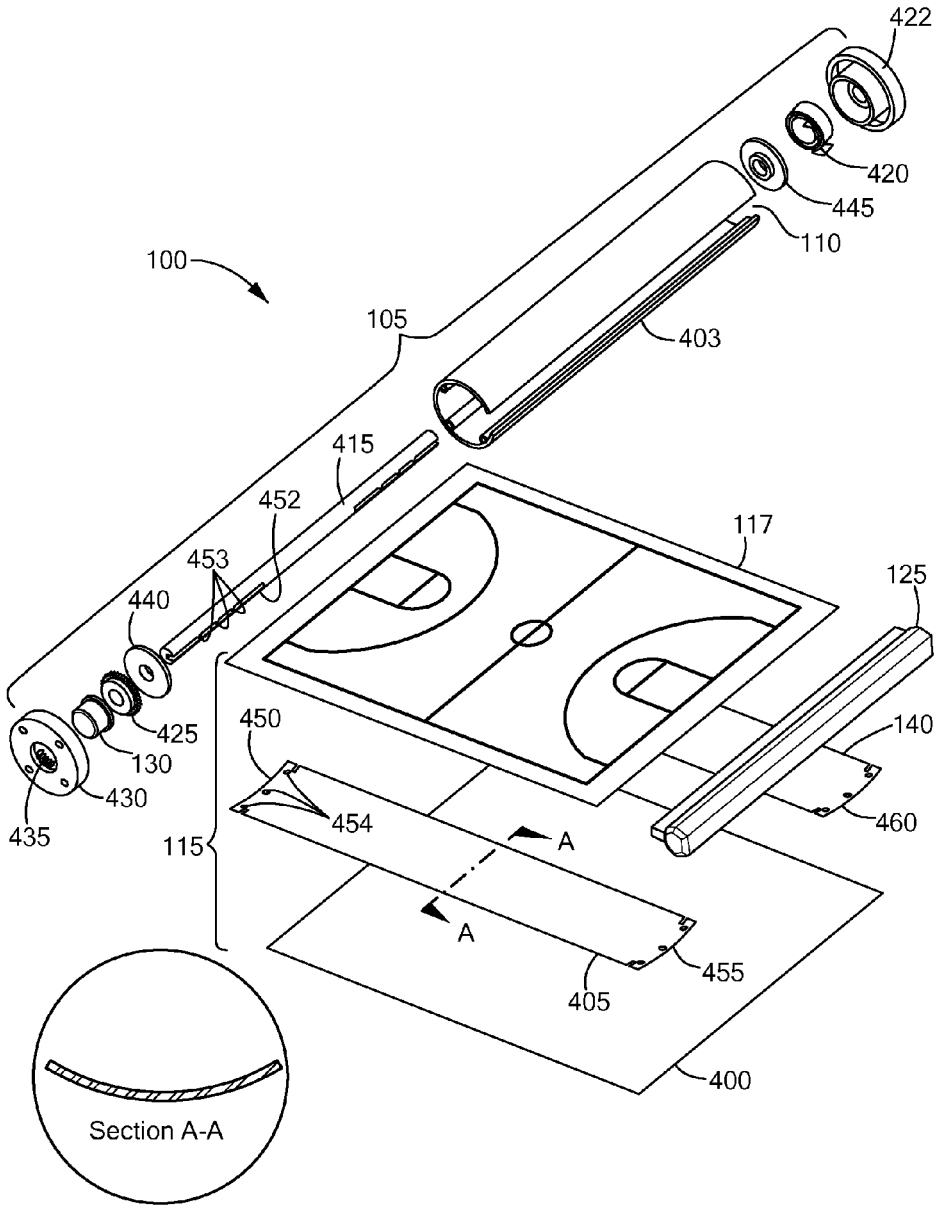
FIG. 4 is a perspective exploded view of the writing device of FIG. 1.

FIG. 4 is a perspective exploded view of the writing device 100. In one embodiment, the retractable member 115 includes the top writing surface 117, a bottom writing surface 400, and two resilient members 405 and 410. In one embodiment, the writing surface 117 provides an available writing area of about 8½ by about 12 inches; however, other size writing surfaces 117 may be used. The retractable member 115 is attached at one edge thereof to a spool 415, such that the retractable member 115 may be spirally wound on the spool 415 when the writing surface 117 is retracted into the housing 105. The spool 415 is disposed within a hollow body 403 that defines the slit 110. The body 403 may be made of plastic, metal or any other suitable material. The body 403 defines an interior volume.

A spring 420 may be attached to an end cap 422 of the housing 105 and to the spool 415. As the retractable member 115 is unwound from the spool 415 and extended from the housing 105, the spring 420 is tensioned, such that the spring urges the spool 415 to rotate so as to retract the writing surface 117 back into the housing 403. A gear 425 is attached to the spool 415 for rotation therewith. A spring (not visible) urges the gear 425 against another end cap 430 of the housing 105. Teeth 435 in the end cap 430 engage teeth of the gear 425 to prevent the spool 415 from rotating to retract the writing surface 117. The button 130 may be used to displace the gear 425 from the end cap 430 sufficiently to disengage the teeth of the gear 425 from the teeth of the end cap 430, thus allowing the spool 415 to rotate and retract the retractable member 115. The teeth 435 of the end cap 430 and/or the teeth of the gear 425 may be configured such that the spool 415 may rotate to extend the retractable member 115 without necessarily pressing the button 130. For example, the teeth 435 of the end cap 430 and/or the teeth of the gear 425 may have sawtooth shapes. Locating collars 440 and 445 maintain the position and orientation of the spool 415 within the body 403.

Optionally or alternatively, another mechanism may be used to selectively prevent or allow the spool 415 to rotate to retract the writing surface 117. For example, a "window shade" ratchet mechanism may be provided for exerting a retractive force on the writing surface 117 in response to a user pulling slightly on the handle 125 and then releasing it.

Figure 5:
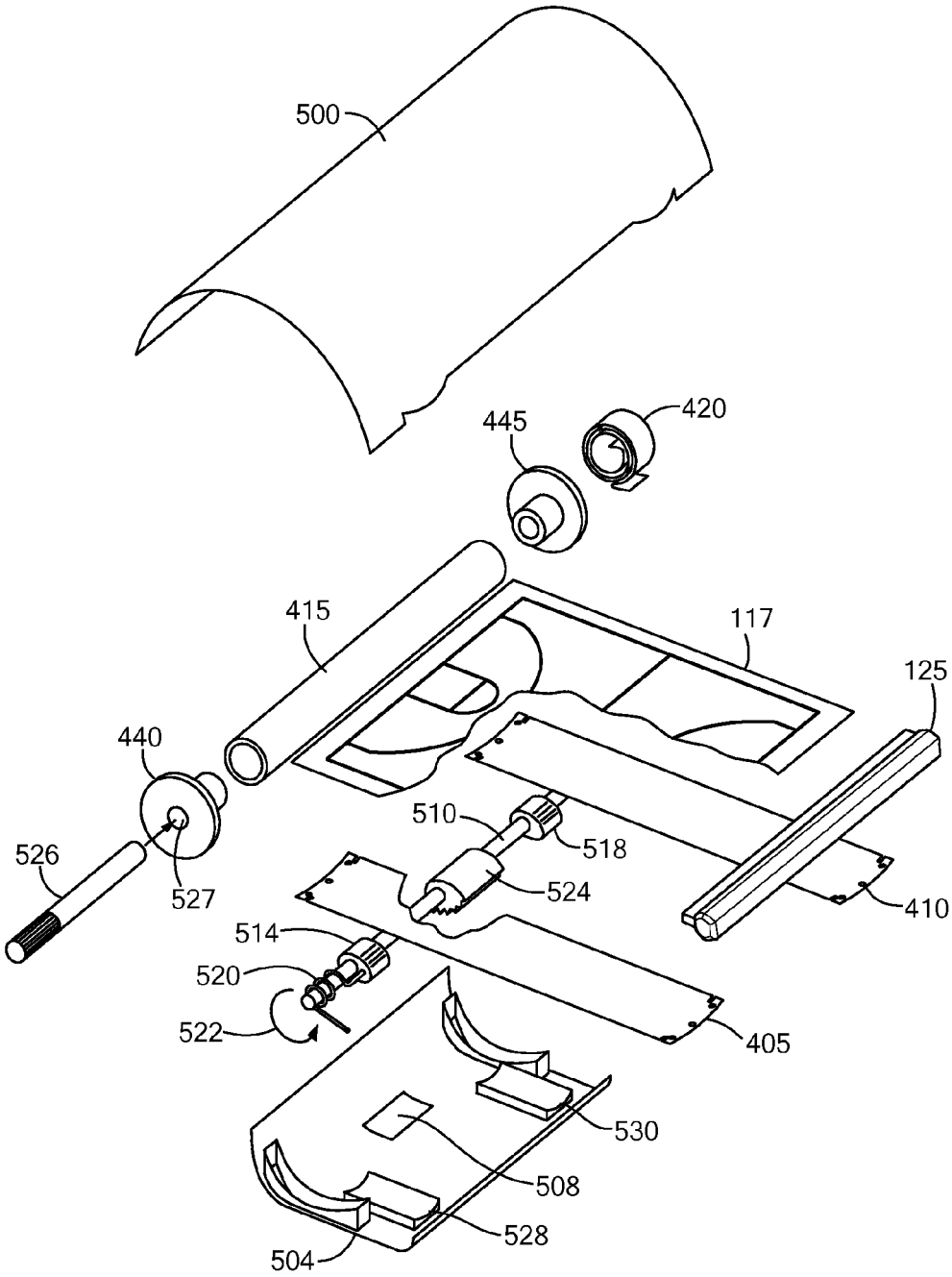
FIG. 5 is a perspective exploded view of a portion of a portable retractable erasable writing device, according to another embodiment of the present invention.
Figure 6:
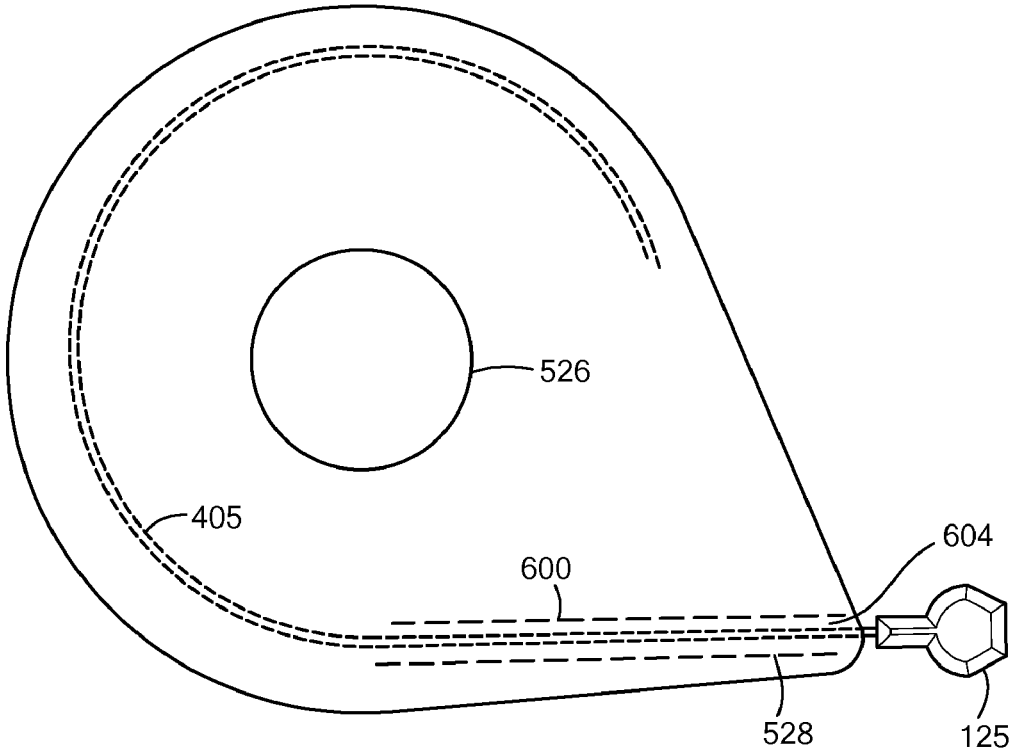
FIG. 6 shows an end view of the writing device of FIG. 5.

FIG. 5 shows an exploded perspective view, and FIG. 6 shows an end view, of a portable retractable erasable writing device according to an alternative embodiment. As shown in FIG. 5, the housing includes two halves 500 and 504. The bottom half 504 of the housing defines an opening 508. A shaft 510, mounted within the housing 500 and 504, has friction brake pads 514 and 518 mounted for rotation therewith. The brake pads 514 and 518 may be rubber or another suitable material and shape that have sufficient coefficients of friction with the material and shapes of the resilient members 405 and 410. The brake pads 514 and 518 may be eccentric, relative to the shaft 510, and the brake pads 514 and 518 may have ridges or other shapes defined thereon to establish the desired friction with the resilient members 405 and 410.

A spring 520 urges the shaft 510 to rotate about its axis, as indicated by arrow 522. Thus, the brake pads 514 and 518 are urged against the bottoms of the resilient member 405 and 410, and friction between the brake pads 514 and 518 and the resilient members 405 and 410 prevents the resilient members 405 and 410 from retracting into housing 500 and 504. That is, the friction enables the resilient members 405 and 410 to resist the force of the spring 420, which would otherwise wind the writing surface 117 onto a spool 415.

A brake release button 524 is attached to the shaft 510, such that when the device is assembled, the brake release button 524 is accessible through the opening 508 in the bottom half of the housing. The brake release button 524 may be eccentric, relative to the shaft 510. Operating the brake release button 524, such as by pressing or rotating the button 524, rotates the shaft 510 opposite the direction of the arrow 522, thus rotating the brake pads 514 and 518 in a direction away from the bottoms of the resilient members 405 and 410, thereby reducing (possibly to zero) the friction between the brake pads 514 and 518 and the resilient members 405 and 410. Removing or reducing the friction enables the spring 445 to rotate the spool 415 and, thereby, retract the writing surface 117 into the housing 500 and 504. Some embodiments omit the spring 420. In these cases, a user urges the writing surface 117 into the housing 500 and 504, forcing the spool 415 to rotate on its axis and spirally winding the writing surface 117 and the resilient members 405 and 410 onto the spool 415. It should be noted that the spool 415 in any embodiment may have more than one diameter. That is, the resilient members 405 and 410 may wind on portions of the spool 415 that have different diameters than the portion of the spool 415 on which the writing surface 117 winds.

A writing implement 526, such as a dry-erase marker, may be releasably stored in a receptacle, which may include a hollow defined at least in part by the spool 415. As shown in FIG. 6, an end portion of the housing 500 and 504 may define an opening or may include a door (not shown), through which the writing implement 526 may be withdrawn for use or returned for storage when not in use. The receptacle may include a toggle mechanism for selectively securing the writing implement 526 in the hollow or releasing the writing implement. In one embodiment, pressing in on the top of the writing implement 526, while the writing implement is secured within the receptacle, releases the writing implement. Inserting the writing implement 526 into an empty receptacle secures the writing implement in the receptacle.

In some embodiments, as can be seen in FIG. 6, the housing 500, 504 has a teardrop cross-sectional shape. Such a shape provides room inside the housing 500, 504 for lower exit ramps 528 and 530 (best seen in FIG. 5). One of the exit ramps 528 and a portion of one of the resilient members 405 are shown in phantom in FIG. 6. The exit ramps 528, 530 provide concave surfaces that complement the convex shapes taken on by the resilient members 405 and 410, when the resilient members unroll from the spool 415. Portions of the resilient members 405 and 410 rest on all or portions of the exit ramps 528 and 530, respectively. Support provided by the exit ramps 528 and 530 enhances the rigidity of the resilient members 405 and 410, when the resilient members are extended from the housing 500 and 504. Optional upper exit guides (one of which is shown in phantom at 600 in FIG. 6) may also be provided to loosely capture the resilient members 405 and 410 between the upper exit guides and lower exit ramps. Thus, the upper exit guides and lower exit ramps, exemplified by exit guide 600 and exit ramp 528, may define channels, exemplified by channel 604, through which the resilient members 405 and 410 extend.

Figure 7:
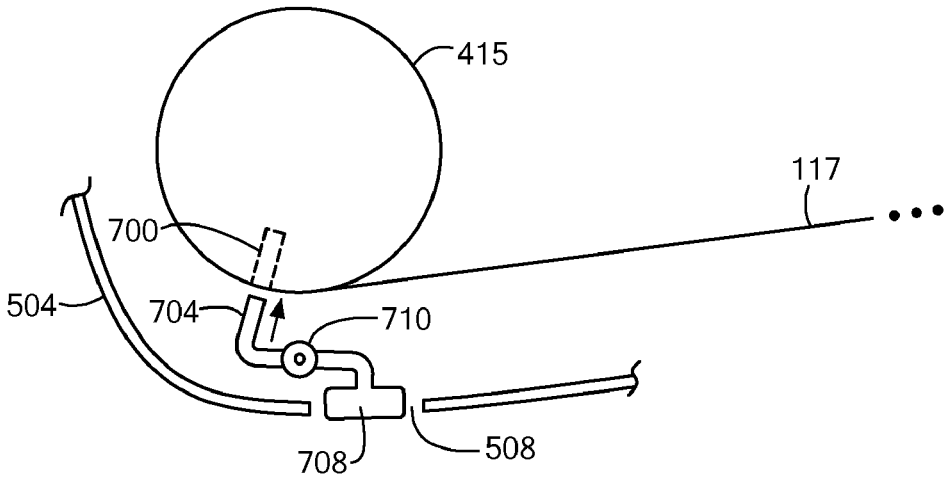
FIG. 7 is a schematic diagram of a brake mechanism, according to one embodiment of the present invention.

FIG. 7 is a schematic diagram of an alternative brake assembly for the spool 415. The spool 415 defines a hole 700 in the surface thereof. A spring-loaded pin 704 is urged toward the surface of the spool 415, as indicated by an arrow. While the writing surface is partially or fully retracted into the housing, i.e., while the writing surface 117 is partially or fully wound around the spool 415, the writing surface 117 prevents the pin from entering the hole 700. However, once the writing surface 117 has been extended, the hole 700 becomes uncovered, and when the spool 415 rotates to align the hole 700 with the pin 704, the pin enters the hole 700 to engage the break and prevent the spool 415 from rotating, thus locking the position of the writing surface 117. A push button 708 may be used to pivot the brake assembly about a pivot 710, so the pin 704 backs out of the hole 700, thus releasing the brake.

Figure 8:
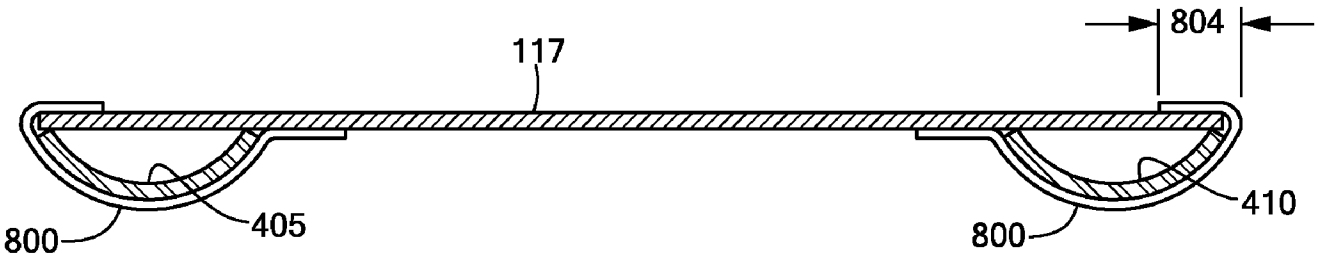
FIGS. 8 and 9 are cross-sectional views of retractable members of the portable retractable erasable writing devices of FIG. 1 or FIG. 5, according to two embodiments of the present invention.
Figure 9:
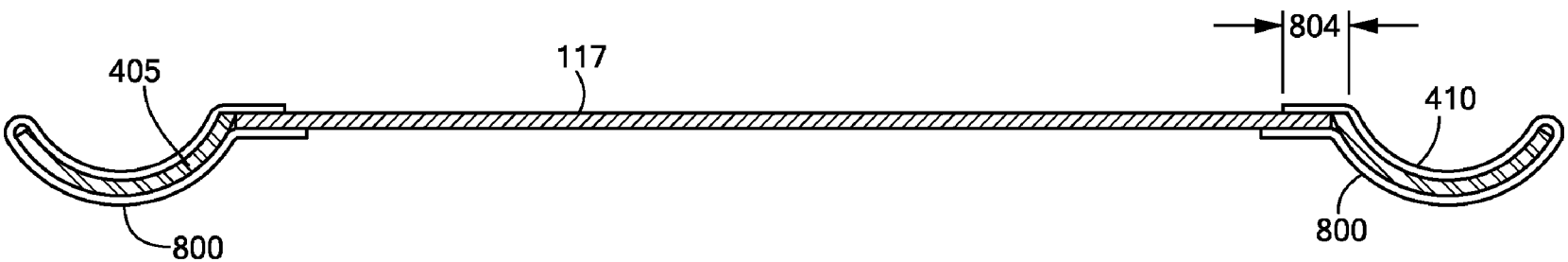

FIGS. 8 and 9 are cross-sectional views of the retractable portions of FIG. 1 or FIG. 5, according to two embodiments of the present invention. In the embodiment shown in FIG. 8, the two resilient members 405 and 410 are disposed completely under the writing surface 117. In the embodiment shown in FIG. 9, the resilient members 405 and 410 are disposed at edges of the writing surface 117. In both cases, the resilient members 405 and 410 may be attached to the writing surface 117 by adhesive tape 800. Depending on the composition of the adhesive tape 800, it may be more difficult to write on the adhesive tape 800 than directly on the writing surface 117. However, only a relatively small amount 804, such as about ½ inch, of the useful portion of the writing surface 117 may be lost to the adhesive tape 800.

Optionally or alternatively, the resilient members 405 and 410 may be attached in other ways to the writing surface 117. For example, one or both edges of the resilient members 405 and 410 may be welded (such as with a solvent or radio-frequency (RF) or ultrasonic energy) or adhered to the edges (if the resilient members 405 and 410 are oriented, relative to the wiring surface 117, as shown in FIG. 9) or to the edges and bottom (if the resilient members 405 and 410 are oriented, relative to the wiring surface 117, as shown in FIG. 8) of the writing surface 117. Alternatively, extruded or stretchy woven sleeves, shaped as indicated at 800 in FIG. 8 or 9, may be used to encase the resilient members 800, and the sleeves may be attached to the writing surface 117 by welding or an adhesive.

Optionally or alternatively, magnets, hook and loop fasteners (also known as hook and pile fasteners) or other permanent or releasable fasteners (not shown) disposed along or near the edges of the writing surface 117 and/or in the resilient members 405 and 410 may cause the writing surface 117 to be attached to the resilient members 405 and 410. The attachment may be permanent or releasable.

Similarly, magnets, hook and loop fasteners or other types of fasteners may be used to attach the writing surface 117 to the handle 125 and/or to the spool 415, Thus enabling the writing surface 117 to be replaced.

In some embodiments (not shown), the writing surface 117 may extend from, and be withdrawn into, the housing independently of the resilient members 405 and 410. Optionally or alternatively, the handle 125 may be hollow, and the writing surface 117 or the resilient members 405 and 410 may roll up in the handle 125, instead of in the housing 105 or 500 and 504.

Returning to FIG. 4, optionally, one or both edges of the body 403 that define the slit 110 may be equipped with an eraser (not shown) such that, as the retractable member 115 is extended from or retracted into the housing 105, the eraser wipes the surface of the retractable member 115 to erase the writing surface 117 and/or 400. The size of the slit 110 and the spacing of the eraser(s) may be such that the retractable member 115 may be selectively brought into contact with the eraser(s), or the retractable member 115 may be extended or retracted without contacting an eraser, depending on an angle 305 or 310 (FIG. 3) at which the retractable member 115 is extended or retracted.

Returning again to FIG. 4, one end 450 of the resilient member 405 is attached to the spool 415, such that the resilient member 405 spirally winds onto the spool 415 as the writing surface 117 is retracted into the housing 105. The spool 415 may define a groove 452, which includes a plurality of spikes 453 configured to engage corresponding holes 454 in the end 450 of the resilient member 405 to attach the resilient member 405 to the spool 415. The resilient member 405 unwinds from the spool 415 as the writing surface 117 is extended from the housing 105. Similarly, the other resilient member 410 is attached to the spool 415 for winding on and unwinding from the spool 415. Other suitable attachment mechanisms, such as screws, rivets, adhesives, welds, friction, etc., may be used.

As shown in the insert of FIG. 4, the resilient member 405 has a curved cross-sectional shape. The other resilient member 410 is similarly shaped. The resilient members 405 and 410 may be made from spring steel, shape memory polymer or any material or combination that provides a shape memory, i.e., any material that returns to the curved shape after a flattening force is removed.

Each resilient member 405 and 410 has a shape memory such that, when not wound on the spool 415, the resilient member 405 or 410 takes on the curved shape described above, as viewed in a cross section taken transverse to the direction in which the resilient member extends from the housing. The curved cross-sectional shape makes the resilient members 405 and 410 rigid, when resilient members 405 and 410 are extended from the housing 105, in a manner similar to the way a spring steel tape measure becomes rigid when extended from its housing. When the resilient members 405 and 410 are retracted into the housing 105 and wound around the spool 415, the resilient members 405 and 410 may take on a less curved or a flat shape.

The other ends 455 and 460 of the resilient members 405 and 410 are attached to the handle 125 by spikes, screws, or other suitable fasteners (not visible) in two grooves (not visible) in the handle 125 and holes 465 and 470 in the ends 455 and 460 of the resilient members 405 and 410. When the resilient members 405 and 410 are extended from the housing 105, the spool 415, the resilient members 405 and 410 and the handle 125 form a frame. The resilient members 405 and 410 thus form structural members.

The writing surface 117 may be attached to the resilient members 405 and 410, and the writing surface 117 is held flat or taught therebetween to provide a rigid writing surface. The handle 125 and the spool 415 are sufficiently rigid to prevent the resilient members 405 and 410 from being deflected toward each other as pressure is applied to the writing surface 117 by a writing implement. The rigidity of the resilient members 405 and 410, and their positional stability relative to each other provided by the handle 125 and the spool 415, prevent the writing surface 117 from significantly deforming when normal writing pressure is applied to the writing surface 117 by a writing implement. The writing surface 117 may also be attached to the handle 125 and/or to the spool 415 to provide additional rigidity to the writing surface 117. The bottom writing surface 400 may be similarly attached to the resilient members 405 and 410 and, optionally, to the handle 125 and/or to the spool 415.

Optionally, one or more additional resilient members (not shown) may be included in the retractable member 115. Such additional resilient members may extend from the spool 415 to the handle 125 and may be disposed between, and parallel to, the above-described resilient members 405 and 410.

Optionally, the retractable member 115, the writing surface 117 and/or 400 may be made of a material having a shape memory and configured such that, when the retractable member 115 is extended from the housing 105, the retractable member 115 has a curved (in cross-section) shape, thereby making the retractable member 115 rigid. In this case, the handle 125 may have a corresponding curved shape.

Figure 10:
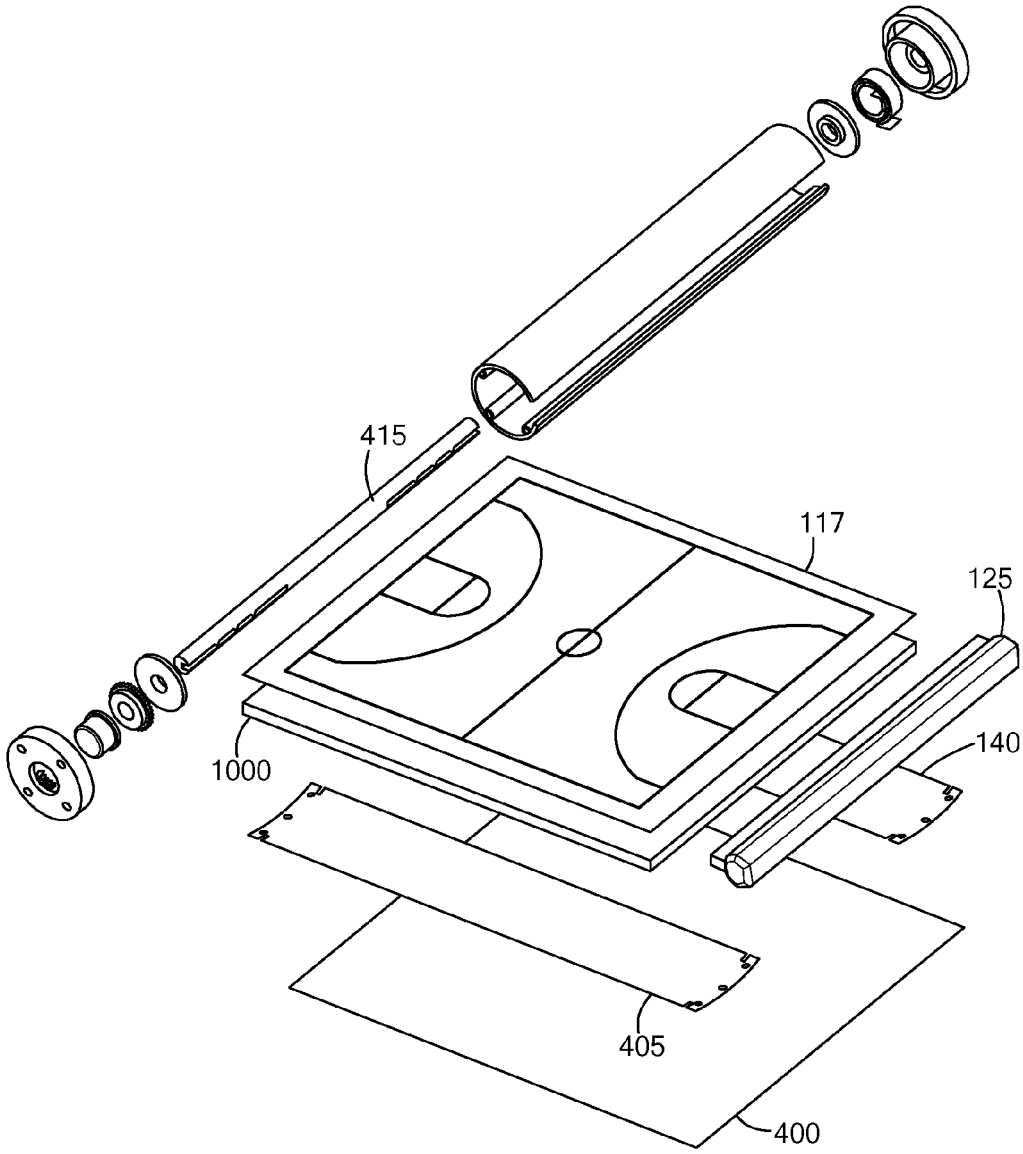
FIG. 10 is a perspective exploded view of a portable retractable erasable writing device, according to yet another embodiment of the present invention.

Optionally, as shown in FIG. 10, a compressible resilient sheet 1000 may be included between the writing surface 117 and the resilient members 405 and 410 to provide additional support for the writing surface 117. A similar sheet (not shown) may be included between the bottom writing surface 400 and the resilient members 405 and 410.

Optionally or alternatively, one or more telescopic members (not shown) may be used in addition to, or in place of, the resilient members 405 and 410 (and the optional additional parallel resilient members described above). Each telescopic member is attached at one end thereof to or inside the housing 105, and at the other end thereof to the handle 125. When the retractable member 115 is extended from the housing 105, the telescopic members elongate; and when the retractable member 115 is retracted back into the housing 105, the telescopic members retract. The edges of writing surface 117 and/or 400 are fixedly or slidably attached along at least portions of their lengths to the telescopic members, such that the writing surface is held flat or taught between the extended telescopic members to provide a rigid writing surface.

The writing surfaces 117 and 400 may be made of any suitable flexible substrate, including paper or plastic film, such as polyester or polypropylene. The substrate may be coated with a suitable radiation-curable lacquer to produce a markable, erasable surface. If the substrate is heat resistant, a heat-curable coating, such as alkyd, urea formaldehyde, melamine and similar high-crosslink density resins, may be used. A temperature-sensitive substrate may be coated and then the coating may be cured by electron beam (EB) and/or ultraviolet (UV) radiation.

The surface tension of the coating should be greater than the surface tension of material, such as dry-erase ink, used to mark the surface. The greater the difference in surface tensions, the better the ink will wet the erasable markable surface. If the writing surface 117 is to be used with dry-erase markers, the minimum surface tension of the cured coating depends primarily on solvents and/or surface active agents in the dry-erase markers. A surface tension of at least about 25 dyne/cm at 22° C. has been found to be acceptable. Other details of forming a suitable erasable writing surface are described in U.S. Pat. No. 5,024,898, titled "Erasably markable articles and methods of making such articles" by Warren R. Pitts, et al, the entire contents of which are hereby incorporated by reference herein, although the resulting writing surface need not necessarily possess the cling or phosphorescent properties of some of the materials described in the referenced patent.

Alternatively, the substrate may be laminated with a suitable dry-erasable material, such as an adhesive-backed clear dry erase sheet material available from OptiMA, Inc., Northborough, Mass. 01532 under the trade name Opti-Rite writing surface.

Optionally or alternatively, the writing surface 117 may be made of another type or other types of erasable or non-erasable writing materials, including writing materials that are magnetically, electrically, electrostatically, optically or mechanically erasable.

Optionally or alternatively, the writing surface 117 may be made of, or include, a flexible computer display screen. Such display screens are available from Polymer Vision, Ltd., Eindhoven, The Netherlands; Plastic Logic, Cambridge, England; and Nanoident, Linz, Austria. The flexible computer display may be coupled to a processor within or attached to the housing. Optionally or alternatively, the processor may be remote from the housing and coupled to the screen via a wired or wireless (such as RF or infrared) link.

Although resilient members 405 and 410 that are distinct from the writing surface 117 have been described, in other embodiments the writing surface may be made with integrated resilient members along the edges of the writing surface. The resilient members may be fused or adhered to the writing surface, or the resilient members and the writing surface may be fabricated as single components. The writing surface may be single or double sided.

The writing device 100 may include a clip or recess (not shown) that may be used to house a marker or other writing implement. The clip or recess may, for example, be provided at the bottom of the writing surface or on the exterior of the housing.

The writing device 100 may include a clip capable of coupling to a belt or other item, thereby enabling the writing device 100 to be carried in a hands-free manner by its user.

The housing 105, the extendable member 115 and/or other components of the writing device 100 may include suction cups or other elements for affixing the writing device 100 or a portion thereof to a wall or to another surface. As a result, the extendable member 115 may be extended to expose the writing surface 117 in a manner suitable for writing, and the writing device 100 may then be affixed to a wall or other surface so that the user may write on the writing surface 117 without holding the writing device 100.

In addition to uses involving sports and coaches, as described above, the disclosed writing device may be used in other contexts or for other purposes. For example, the writing device may be used by people who are deaf or hard of hearing or who have temporarily or permanently lost use of their voices, such as people with throat cancer. Other possible users include police and military personnel in tactical situations, as well as trainers and educators. In some contexts, the writing surface may have pre-printed lines, words, diagrams or icons, or the writing surface may be blank. The writing device may be used as a convenient medium for written or drawn communication with other people. Some writing devices may be smaller or larger than the sports-related embodiments.

While the invention is described through the above-described exemplary embodiments, it will be understood by those of ordinary skill in the art that modifications to, and variations of, the illustrated embodiments may be made without departing from the inventive concepts disclosed herein. While specific values chosen for these embodiments are described, it is to be understood that, within the scope of the invention, the values of all of parameters may vary over wide ranges to suit different applications. Furthermore, disclosed aspects, or portions of these aspects, may be combined in ways not listed above. Accordingly, the invention should not be viewed as being limited to the disclosed embodiments.

What is claimed is:

1. A portable writing device, comprising:

a housing defining a slit;

a handle;

a flexible writing surface attached at a first edge thereof to the handle and configured for extension and refraction through the slit and to wind within the housing, when the writing surface is refracted into the housing;

a first resilient member configured to alternatively extend from and retract into at least one of the housing and the handle, and to wind within at least one of the housing and the handle when the first resilient member is retracted; the first resilient member having a shape memory such that, when not wound, the first resilient member takes on a curved shape, as viewed in a cross section taken transverse to the direction in which the first resilient member extends from the housing, the first resilient member being attached substantially along its length to the writing surface, proximate a second edge thereof, and an exit ramp disposed within the housing, shaped to complement the curved shape of the first resilient member, and configured to support a portion of the first resilient member, whereby when the writing surface is extended, the writing surface is sufficiently rigid to avoid objectionable deflection in the course of handwriting on the writing surface.

2. A portable writing device according to claim 1, wherein the writing surface comprises paper.

3. A portable writing device according to claim 1, wherein the writing surface comprises a markable, erasable surface.

4. A portable writing device according to claim 1, wherein the writing surface comprises non-erasable indicia corresponding to markings on a game playing surface.

5. A portable writing device according to claim 1, wherein the writing surface comprises a flexible computer display screen.

6. A portable writing device according to claim 1, wherein the writing surface is releasably attached to the handle and to the first resilient member.

7. A portable writing device according to claim 1, further comprising:

a second resilient member configured to alternatively extend from and retract into at least one of the housing and the handle, and to wind within at least one of the housing and the handle when the second resilient member is retracted, the second resilient member having a shape memory such that, when not wound, the second resilient member takes on a curved shape, as viewed in a cross section taken transverse to the direction in which the second resilient member extends from the housing, the second resilient member being attached substantially along its length to the writing surface, proximate a third edge, parallel to the second edge, thereof;

wherein the handle and the first and second resilient members are configured such that, when the writing surface is in an extended position, the handle and the first and second resilient members form at least part of a frame for the writing surface.

8. A portable writing device according to claim 7, wherein the first and second resilient members comprise spring steel.

9. A portable writing device according to claim 7, wherein the first and second resilient members comprise a shape memory polymer.

10. A portable writing device according to claim 7, further comprising a spring disposed within the housing and configured to urge winding of the writing surface, so as to retract the writing surface.

11. A portable writing device according to claim 10, further comprising a releasable latch configured to selectively prevent the writing surface from winding.

12. A portable writing device according to claim 10, further comprising a releasable brake coupled to the first resilient member and configured to selectively prevent the resilient member from retracting.

13. A portable writing device according to claim 7, further comprising a compressible resilient sheet attached to one surface of the writing surface and coextensive with at least a writing portion of the writing surface.

14. A portable writing device according to claim 1, further comprising a receptacle configured to releasably hold a writing implement.

15. A portable writing device, comprising:

a housing;

a flexible writing surface retractably disposable within the housing, the writing surface having a first position wherein the writing surface is disposed within the housing, and a second position wherein a substantial portion of the writing surface is disposed outside of the housing;

a first resilient structural member attached substantially along its length to the writing surface proximate a first edge thereof and configured such that at least a substantial portion of the first structural member is disposed within the housing when the writing surface occupies the first position and such that, when the writing surface occupies the second position, at least a substantial portion of the first structural member is disposed outside of the housing, the first resilient structural member having a shape memory such that, when the writing surface occupies the second position, the first resilient member takes on a curved shape, as viewed in a cross section taken transverse to the direction in which the first resilient member extends from the housing and an exit ramp disposed within the housing, shaped to complement the curved shape of the first resilient structural member, and configured to support a portion of the first resilient member, whereby when the writing surface occupies the second position, the writing surface is sufficiently rigid to avoid objectionable deflection in the course of handwriting on the writing surface.

16. A portable writing device according to claim 15, wherein the writing surface comprises paper.

17. A portable writing device according to claim 15, wherein the writing surface comprises a markable, erasable surface.

18. A portable writing device according to claim 15, wherein the writing surface comprises non-erasable indicia corresponding to markings on a game playing surface.

19. A portable writing device according to claim 15, wherein the writing surface comprises a flexible computer display screen.

20. A portable writing device according to claim 15, wherein the first structural member comprises a spring steel member.

21. A portable writing device according to claim 15, further comprising:

a second resilient structural member attached substantially along its length to the writing surface proximate a second edge, parallel to the first edge, thereof in such a manner that at least a substantial portion of the second structural member is disposed within the housing when the writing surface occupies the first position and such that, when the writing surface occupies the second position, at least a substantial portion of the second structural member is disposed outside of the housing; and wherein:

the first and second structural members are configured such that, when the writing surface occupies the second position, the writing surface extends substantially flat between the first and second structural members.

22. A portable writing device according to claim 21, further comprising a compressible resilient sheet attached to one surface of the writing surface and coextensive with at least a writing portion of the writing surface.

23. A portable writing device, comprising:

a housing defining a slit;

a handle;

a flexible writing surface attached at a first edge thereof to the handle and configured for extension and retraction through the slit and to wind within the housing, when the writing surface is retracted into the housing;

a first resilient member configured to alternatively extend from and retract into at least one of the housing and the handle, and to wind within at least one of the housing and the handle when the first resilient member is retracted; the first resilient member having a shape memory such that, when not wound, the first resilient member takes on a curved shape, as viewed in a cross section taken transverse to the direction in which the first resilient member extends from the housing, the first resilient member being attached substantially along its length to the writing surface, proximate a second edge thereof;

a second resilient member configured to alternatively extend from and retract into at least one of the housing and the handle, and to wind within at least one of the housing and the handle when the second resilient member is retracted; the second resilient member having a shape memory such that, when not wound, the second resilient member takes on a curved shape, as viewed in a cross section taken transverse to the direction in which the second resilient member extends from the housing, the second resilient member being attached substantially along its length to the writing surface, proximate a third edge thereof;

a first exit ramp disposed within the housing and configured to support a portion of the first resilient member; and a second exit ramp disposed within the housing and configured to support a portion of the second resilient member, whereby when the writing surface is extended, the writing surface is sufficiently rigid to avoid objectionable deflection in the course of handwriting on the writing surface.

* * * * *

UNITED STATES PATENT AND TRADEMARK OFFICE

CERTIFICATE OF CORRECTION

PATENT NO. : 8,100,697 B2
APPLICATION NO. : 12/401942
DATED : January 24, 2012
INVENTOR(S) : Robert Budryk and Tobin J. Fisher It is certified that error appears in the above-identified patent and that said Letters Patent is hereby corrected as shown below:

Column 10, Line 20, Claim 1, the word “refraction” should be “retraction”
Column 10, Line 22, Claim 1, the word “refracted” should be “retracted”

Signed and Sealed this
Sixteenth Day of October, 2012

David J. Kappos

David J. Kappos
*Director of the United States Patent and Trademark Office*